United States Patent [19]

Drexler et al.

[11] Patent Number: 4,746,779

[45] Date of Patent: May 24, 1988

[54] CONTACT ARRANGEMENT FOR SWITCHGEAR

[75] Inventors: Johann Drexler, Schwandorf; Erwin Flierl, Kuemmersbruck, both of Fed. Rep. of Germany

[73] Assignee: Siemens Aktiengesellschaft, Berlin and Munich, Fed. Rep. of Germany

[21] Appl. No.: 924,704

[22] Filed: Oct. 29, 1986

Related U.S. Application Data

[63] Continuation of Ser. No. 716,847, Mar. 28, 1985, abandoned.

[30] Foreign Application Priority Data

Mar. 29, 1984 [DE] Fed. Rep. of Germany ..... 3411687

[51] Int. Cl.[4] ..... H01H 1/32

[52] U.S. Cl. ..... 200/248; 200/16 A; 200/243; 200/272

[58] Field of Search ..... 200/239, 241–251, 200/271, 272, 16 A, 16 R

[56] References Cited

U.S. PATENT DOCUMENTS

| | | | |
|---|---|---|---|
| 2,655,583 | 10/1953 | Souter | 200/248 X |
| 3,448,226 | 6/1969 | Mading et al. | 200/243 |
| 3,864,652 | 2/1975 | Zubaty et al. | 200/248 X |
| 4,634,819 | 1/1987 | Ikeda | 200/16 A |

FOREIGN PATENT DOCUMENTS

| | | | |
|---|---|---|---|
| 1765920 | 10/1971 | Fed. Rep. of Germany . | |
| 2253918 | 5/1974 | Fed. Rep. of Germany . | |
| 2205724 | 5/1974 | France . | |
| 2410348 | 7/1978 | France . | |
| 188134 | 12/1936 | Switzerland | 200/271 |
| 618805 | 8/1978 | U.S.S.R. | 200/250 |

*Primary Examiner*—Henry J. Recla
*Assistant Examiner*—Ernest G. Cusick
*Attorney, Agent, or Firm*—Volker R. Ulbrich; John L. James

[57] ABSTRACT

A contact arrangement for switchgear with multiple disconnects by contact points connected in parallel of two contact bridges aligned in a contact actuation link uses a spring collar for a contact pressure spring. The spring collar has cutouts transverse to the spring-action direction into which the contact bridges with the spring collars can be inserted and locked in place transverse to their longitudinal direction. The spring collar is rounded at two facing sliding surfaces in the contact actuation link aligned transverse to the longitudinal direction of the contact bridges. This assures optimal fitting of the contact bridges to the fixed contact components without jamming the spring collar in the alignment.

5 Claims, 1 Drawing Sheet

CONTACT ARRANGEMENT FOR SWITCHGEAR

CROSS REFERENCE TO RELATED APPLICATIONS

This is a continuation of application Ser. No. 716,847, filed Mar. 28, 1985, now abandoned.

BACKGROUND OF THE INVENTION

This invention relates to a contact arrangement for switchgear with multiple disconnects by points of contact connected in parallel of two contact bridges aligned in a contact actuation link via a spring collar serving as the contact pressure spring, with the spring collar having cutouts running transverse to the spring-action alignment, into which the contact bridges with the spring collar can be inserted and locked in place transverse to their longitudinal alignment.

German Pat. No. 2,253,918, which issued to Fherl et al on May 6, 1976, discloses a contact design of the above type wherein the spring collar is aligned with level surfaces in the contact actuation link. To adjust the individual contact bridges to their counter contacts, the contact bridges have a relatively large play in the spring collar, and they themselves are designed elastically. Because of the large play in the spring collar, jamming of the spring collar in the slider alignment can occur which hinders even alignment of the two fixed contact pieces. Accordingly, it will be appreciated that it would be highly desirable to provide a contact arrangement for switchgear which resists jamming of the spring collar in the slider alignment and facilitates reliable contact of both contact bridges notwithstanding uneven alignment of the two fixed contact pieces.

It is an object of the present invention to provide a contact arrangement which ensures reliable contact of both contact bridges.

Another object of the present invention is to provide a contact arrangement which facilitates smooth interaction of the spring collar in the slider arrangement.

Another object of the present invention is to avoid jamming of the spring collar in the slider alignment to ensure reliable contact of both contact bridges even when there is uneven alignment of the two fixed contact pieces.

SUMMARY OF THE INVENTION

Briefly stated, in accordance with one aspect of the invention, the foregoing objects are achieved by providing a contact arrangement for switchgear with multiple disconnects having parallel-connected contact points of two contact bridges aligned in a contact actuation link using a spring collar as the contact pressure spring. The spring collar has cutouts running transverse to the spring action alignment into which the contact bridges with the spring collar can be inserted and locked in place transverse to the longitudinal axis. There is provided a spring collar which is rounded at a minimum of two slide surfaces of the spring collar in the contact actuation link running transverse to the longitudinal axis of the contact bridge.

Rounding of the slide surfaces avoids jamming of the spring collar in the slider alignment and permits reliable contact of both contact bridges. Jamming is avoided even given uneven alignment of the two fixed contact pieces.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF THE PREFERRED EMBODIMENT

Figure 2:
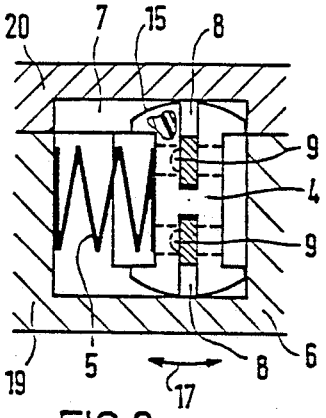
FIG. 2 A frontal view of the contact arrangement in accordance with FIG. 1, also partially in cross-section.
Figure 1:
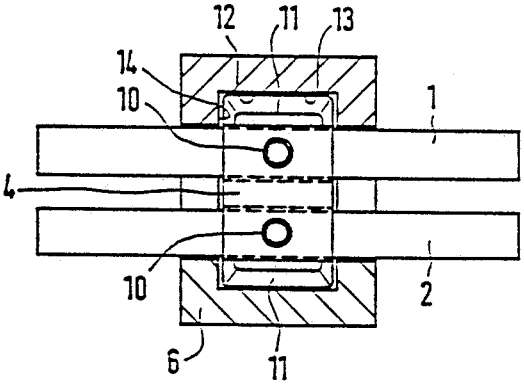
FIG. 1 A diagrammatic plan view of the contact arrangement for switchgear with the contact bridges inserted in the spring collar, with the contact actuation link partially in cross-section.
Figure 3:
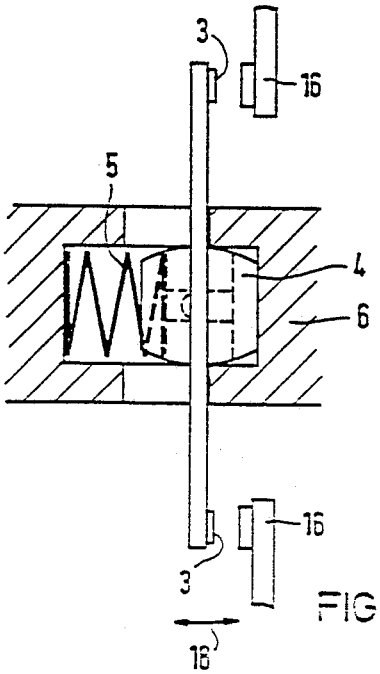
FIG. 3 A side view of the arrangement of FIG. 1, similarly partially in cross-section.

Referring to FIGS. 1–3, a switchgear contact arrangement is shown with multiple disconnects which consists of two contact bridges 1,2 equipped with the contact points forming the contact surfaces 3, the spring collar 4, the contact pressure spring 5, and the actual contact actuation link 6. The contact actuation link 6 has a window-shaped opening 7 with the contact pressure spring 5 supported on one side, while the contact bridges 1 and 2 mate with the other side via spring collar 4, as shown in FIG. 3. The spring collar has side cutouts 8 into which the contact bridges 1 and 2 are inserted; the nubs 9 on the contract bridges 1, 2 thereby mesh in the corresponding slightly larger diameter side-shaped cutouts 10 in the spring collar 4 so that a certain amount of freedom of movement of the contact bridges 1, 2 with respect to the spring collar 4 is retained. A total shift of position, however, is excluded.

As FIG. 1 shows, the spring collar has sections 11 which extends beyond the long sides of contact bridges 1, 2. The sections 11 are surrounded by U-shaped recesses or cutouts 12 bounded at one end by walls 13 and 14 of the contact actuation link so that the spring collar is aligned to slide both along the side walls 13 of the window-shaped opening 7 as well as along the walls 14 running perpendicularly thereto. The sliding surfaces 15 of the spring collar facing the side walls 13 or 14 are rounded both in reference to the side wall 13 as well as in reference to the side wall 14, thus permitting the contact bridge to tilt, i.e., can move both in a longitudinal direction along with the spring collar, as well as in a transverse direction so that the contact bridges can rotate around skewed fixed contact components 16 on the one hand and around their own longitudinal axis to compensate for tolerances on the other hand. These two directions of tilt are depicted by arrows 17 in FIG. 1 and 18 in FIG. 3.

This oscillating capability of the spring collar permits optimum adjustment of the contact bridges to the fixed contact components without fearing any jamming of the spring collar in the alignment. To insert the spring collars into the contact actuation link, the latter is divided into a lower portion 19 and an upper portion 20 which, for example, can be assembled with the contact bridges using snaps after inserting the spring into the spring collar.

This invention avoids a jamming of the spring collar in the slider alignment and permits reliable contact of both contact bridges, even given uneven alignment of the two fixed contact pieces. This is realized in a simple fashion by having the spring collar rounded at least at the two opposite sliding surfaces of the spring collar in the contact actuation link running transverse to the longitudinal direction of the contact bridge. In order to permit tilting of the contact bridges in several directions while maintaining side alignment of the spring collar, it is advantageous if the spring collar extends beyond the longitudinal sides of the contact bridges and is surrounded in a U-shape by the contact actuation link and rounded in the overhanging area in both of the vertically facing sliding surfaces.

To insert the contact bridges in the spring collar with good sliding characteristics in the contact actuation link, it has proven advantageous if the spring collar is made of thermoplastic material. To assure good contact of the spring in the spring collar and also to be able to rotate the spring collar by 180 degrees to obtain both opening and closing contact, it is furthermore advantageous if the spring collar has an essentially H-shaped cross-section. Cutouts for the spring are designed into both longitudinal sides of the H.

It will now be understood that there has been disclosed a contact arrangement including a spring collar which is rounded at the slide surfaces of the spring collar in the contact actuation link running transverse to the longitudinal axis of the contact bridge. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. In a contact arrangement for switchgear with multiple disconnects having parallel-connected contact points of two contact bridges having long sides or widths and a longitudinal axis aligned in a contact actuation link using a spring collar and a contact pressure spring, said spring collar having ends, four sliding guide surfaces on at least one end, said surfaces defining extended areas directly opposed to each other, said spring collar also having cutouts running transverse to the line of action of said spring collar in said contact actuation link into which the contact bridges with the spring collar can be inserted and locked in place transverse to the longitudinal axis, the improvement wherein:

the spring collar is constructed of thermoplastic material, is essentially a rectangular parallelepiped in shape and is rounded on said all four sliding guide surfaces of said at least one end of the spring collar in the contact actuation link running transverse to the longitudinal axis of the contact bridge;

the contact actuation link is U-shaped on at least one end; and the spring collar extends beyond the long sides or widths of the contact bridges and is surrounded by the U-shaped end of said actuation link and rounded in the extended area on each of the sliding surfaces directly opposed to each other.

2. A contact arrangement in accordance with claim 1, wherein the spring collar has a generally H-shaped cross-section.

3. In a contact arrangement for switchgear with multiple disconnects having parallel-connected contact points of two contact bridges having long sides or widths and a longitudinal axis aligned in a contact actuation link using a spring collar and a contact pressure spring, said spring collar having at least four sliding guide surfaces on at least one end, said surfaces defining extended areas directly opposed to each other, said spring collar also having cutouts running transverse to the line of action of said spring collar in said contact actuation link into which the contact bridges with the spring collar can be inserted and locked in place transverse to the longitudinal axis, the improvement wherein:

the spring collar is rounded at a minimum of four of said sliding guide surfaces of at said least one end of the spring collar in the contact actuation link running transverse to the longitudinal axis of the contact bridge;

the contact actuation link is U-shaped on at least one end; and the spring collar extends beyond the long sides or widths of the contact bridges and is surrounded by the U-shaped end of said contact actuation link and rounded in the extended area on each of the sliding surfaces directly opposed to each other.

4. A contact arrangement in accordance with claim 3, wherein the spring collar is constructed of thermoplastic material.

5. A contact arrangement in accordance with claim 3, wherein the spring collar has a generally H-shaped cross-section.

* * * * *